United States Patent [19]

Johnson

[11] 4,050,214

[45] Sept. 27, 1977

[54] METHOD OF ERECTING A TOWER STRUCTURE

[75] Inventor: Roy W. P. Johnson, Greenwich, Conn.

[73] Assignee: Tower Technology, Inc., Minneapolis, Minn.

[21] Appl. No.: 707,757

[22] Filed: July 22, 1976

Related U.S. Application Data

[62] Division of Ser. No. 541,587, Jan. 16, 1975, Pat. No. 3,994,108.

[51] Int. Cl.[2] ..... E04B 1/35; E04H 5/12; E04H 12/00

[52] U.S. Cl. ..... 52/745; 52/83; 52/247; 261/DIG. 11

[58] Field of Search ..... 52/247, 222, 80, 23, 52/63, 84, 83, 148, 245, 152, 741, 742, 747, 745; 261/108, 111, 109, DIG. 11; 135/8; 47/2, 21, 30

[56] References Cited

U.S. PATENT DOCUMENTS

| | | | |
|---|---|---|---|
| 837,912 | 12/1906 | Brown | 52/745 |
| 2,258,084 | 10/1941 | Baker | 135/8 |
| 3,057,054 | 10/1962 | Barnes | 52/741 X |
| 3,195,943 | 7/1965 | Taylor et al. | 135/8 X |
| 3,260,028 | 7/1966 | Fraser | 52/745 |
| 3,331,168 | 7/1967 | Frey | 52/83 X |
| 3,422,883 | 1/1969 | Daltry | 52/83 X |
| 3,637,193 | 1/1972 | Kuglo et al. | 52/83 |
| 3,673,754 | 7/1972 | Murashige et al. | 52/747 |
| 3,791,093 | 2/1974 | Finsterwalder et al. | 52/745 |
| 3,822,522 | 7/1974 | Termohlen | 52/745 |
| 3,918,518 | 11/1975 | James | 251/DIG. 11 |
| 3,945,106 | 3/1976 | Mazi et al. | 52/745 X |
| 3,967,699 | 7/1976 | Jasch | 52/83 |

FOREIGN PATENT DOCUMENTS

| | | | |
|---|---|---|---|
| 2,243,484 | 3/1974 | Germany | 52/83 |
| 2,142,491 | 3/1973 | Germany | 52/84 |
| 2,154,967 | 5/1973 | Germany | 52/83 |
| 2,243,485 | 3/1974 | Germany | 52/83 |
| 1,335,002 | 10/1973 | United Kingdom | 52/84 |

*Primary Examiner*—Leslie Braun

*Attorney, Agent, or Firm*—Fitzpatrick, Cella, Harper & Scinto

[57] ABSTRACT

A tower structure and a method of erecting same wherein said structure comprises a series of rings stacked in end to end relationship with sealing means between adjacent rings to form a tubular section, anchor means are provided exterior and interior of said section and stabilizing means connect said section at spaced locations along its length to said anchor means.

4 Claims, 8 Drawing Figures

11
15
16
17
19
22
23
25
26
27
28
29
30
31

METHOD OF ERECTING A TOWER STRUCTURE

This is a division of application Ser. No. 541,587 filed Jan. 16, 1975, now U.S Pat. No. 3,994,108. .

This invention relates to tower structures such as natural draft, hyperbolic cooling towers, for example, and a method of erecting same.

Heretofore such tower structures have frequently included shells of reinforced concrete or a complex metal frame covered on one side with a sheet of material such as corrugated plastic. Another proposed construction contemplates positioning a lower ring at the desired height on support legs, suspending a top ring from a mast, stretching a network of wires between the two rings and applying a cementitious material to the network of wire. With respect to the foregoing constructions, patents of interest are U.S. Pat. Nos. 3,764,121, 3,648,990 and 3,300,942.

In practise, hyperbolic cooling tower structures known to me are usually formed of reinforced concrete and such towers, as well as those others mentioned above, are complex and expensive and require considerable erection time. For example, towers of the type in question may be required to rise to a height of between 300 and 600 feet and more, and may have base diameters of the order of several hundred feet or more. It has not been unusual in constructing such towers to require the services of forty workmen for as long as twelve months.

Accordingly, I have conceived and contribute by my invention, a tower structure and a method of erecting same by which I am able to overcome the foregoing difficulties and disadvantages. Thus, in a typical case, I am able to construct a hyperbolic cooling tower of conventional dimensions in about four months utilizing less than ten working men.

Essentially, a tower according to the present invention is formed of a series of rings stacked in end to end relationship, sealing means between adjacent rings and cooperating with the rings to form a tubular section, anchor means exterior of the tubular section and stabilizing means connected to the tubular section at spaced locations along its length and to the anchor means. In actual practise, I prefer that the anchor means be spaced radially and equidistantly from the center of the base of the structure and annularly equidistantly from each other, and that the stabilizing means be cables.

The rings may be formed of plastic sheets of polystyrene or polypropelene, for example, and sheets made according to the teachings of U.S. Pat. No. 3,765,810 are satisfactory for this purpose. Adjacent sheets of each ring may be secured together by I-channels.

The sealing means may comprise metal T-rings positioned with a horizontal leg between adjacent plastic rings and a vertical leg overlapping the inner margins of the adjacent rings. A suitable plastic or rubber sealing compound is applied between opposed faces of the plastic rings and the T-rings.

A top ring, preferably of metal, is also provided along the upper end of the first or uppermost plastic ring and this top ring need only be a flat ring secured to the upper end of the top plastic ring.

Spaced loops may be formed on or secured to the outer edge of the top ring and similar loops may be located on both the inner and outer ends of the T-rings, all for a purpose later to be described.

The function of hyperbolic cooling towers is well known and will not be described herein. Thus, for present purposes, it is only necessary to understand that the portion of the tower, i.e. the flue already briefly described, will be positioned above a cooling pond from which it will be separated by a latticework of supporting members to permit ambient air to enter the lower end of the tower above the pond and to pass up through the tower cooling water flowing downward through stuffing material to the pond.

Another aspect of my invention is directed to a method of erecting a tower of the type described. Thus, according to my novel method, I position a first plastic ring having a desired height on a substantially flat surface such as the ground. This ring is equipped with a top ring and is then raised to a position above the surface and a second ring is positioned below it, the adjacent ends of the two rings are sealed by the aforementioned T-ring and sealing compound, both rings are raised together and the process is repeated until the first ring reaches the desired height. It will be appreciated that the mean diameter of the respective rings may vary somewhat in order to give the final tower structure a desired contour, thus to form a hyperbolic tower, for example. On the other hand, cylindrical structures such as grain elevators or silos can as readily be constructed by my method as will be appreciated by those persons skilled in the art.

In the actual construction of the tower, a series of sheaves or pulleys are positioned at various levels along the length of a vertical mast or the like. In some cases, a standing chimney may be useful for this purpose, but if one is not available, then a vertical mast is erected.

A first ring formed of the individual plastic sheets already mentioned, is positioned around the mast, cables are attached to the top ring attached to the upper end of the plastic ring and these cables are reeved through the uppermost series of sheaves and, by drawing downwardly on the other ends of these cables, the first ring is raised to a desired height above the ground and around the mast. A second plastic ring is positioned below the first such ring and its upper end is sealed to the lower end of the first ring by sealing means which may include a T-ring or the like. Cables reeved through the second series of sheaves downwardly from the top of the mast are attached to the top of the second plastic ring or to the T-ring between the first and second plastic rings, and both plastic rings are raised a desired height by drawing downwardly on both sets of cables. This procedure is repeated adding plastic rings at the bottom until the uppermost such ring reaches the desired height, after which all of the free ends of the cables are anchored.

Either during or after completion of the structure, additional series of cables may be connected each to the top of the plastic rings, by the top ring in the case of the first plastic ring, and to the T-rings in the other cases, and these cables, annularly equidistant from each other around the structure are anchored a suitable radial distance from the structure to add stability to same.

In some cases, it will be desirable to reinforce and rigidify the structure, and to this end I may apply metal straps around the exterior of each plastic ring at its upper and lower marginal ends.

It will be appreciated that the ultimate structure may be contoured by employing contoured plastic rings or by forming successive plastic rings at slight angles to each other. By this means, well known hyperhbolic towers may be formed.

Where certain types of cooling towers are contemplated, it is necessary to allow ambient air to be drawn into the tower at its bottom. For this purpose, I lift the several assembled rings as already described, and construct a suitable latticework support structure therebeneath to engage the lowermost plastic ring and support the structure while permitting air to pass into the same.

There has thus been outlined rather broadly the more important features of the invention in order that the detailed description thereof that follows may be better understood, and in order that the present constribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

Specific embodiments of the invention have been chosen for purposes of illustration and description, and are shown in the accompanying drawings forming a part of the specification wherein:

FIG. 3 is a detail view, partly in section, illustrating the assembly of the uppermost plastic ring, its top ring and the lifting and stabilizing cables;

Figure 1:
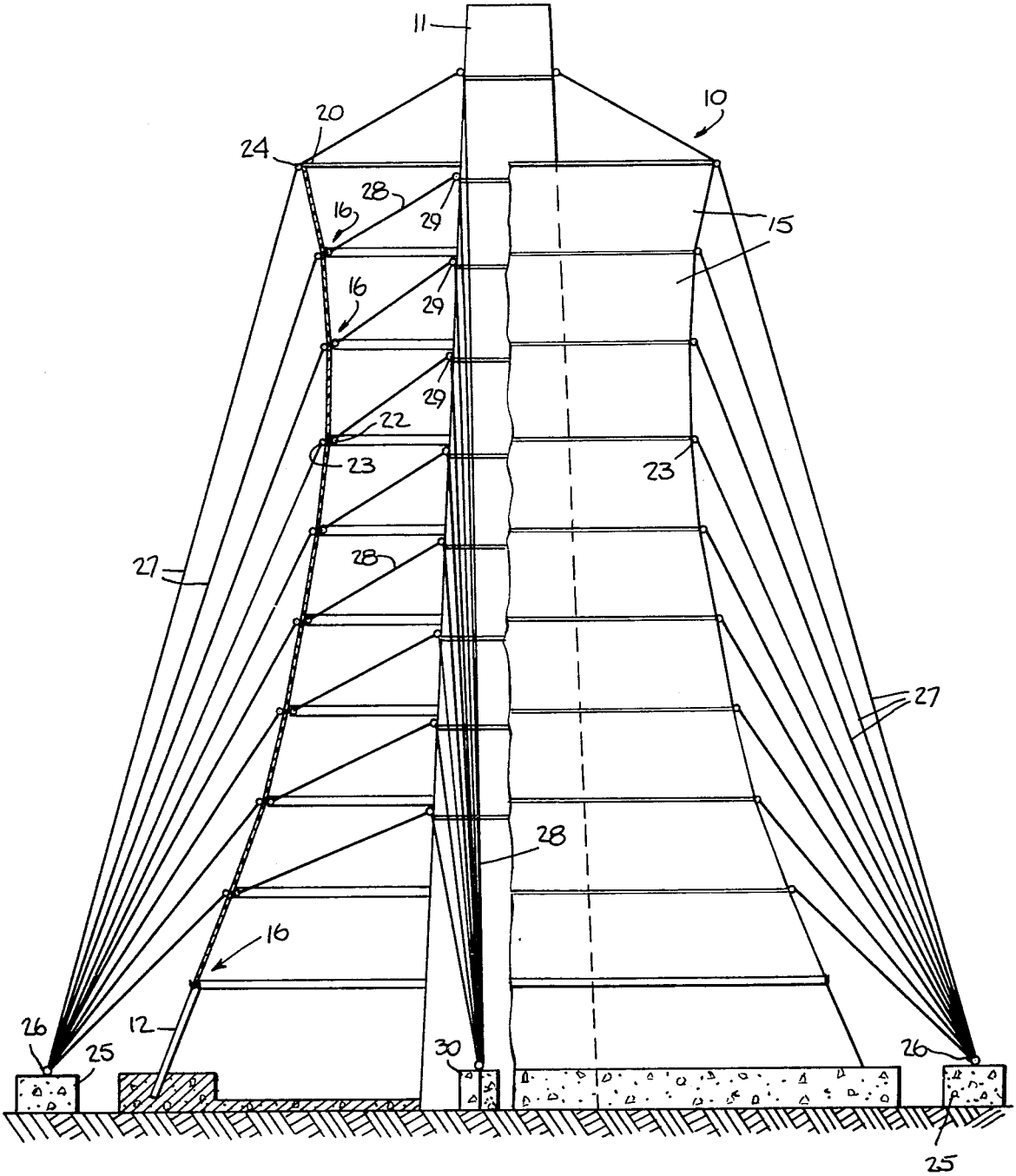
FIG. 1 is an elevational view, partly broken away, and illustrating a tower structure according to my invention.
Figure 2:
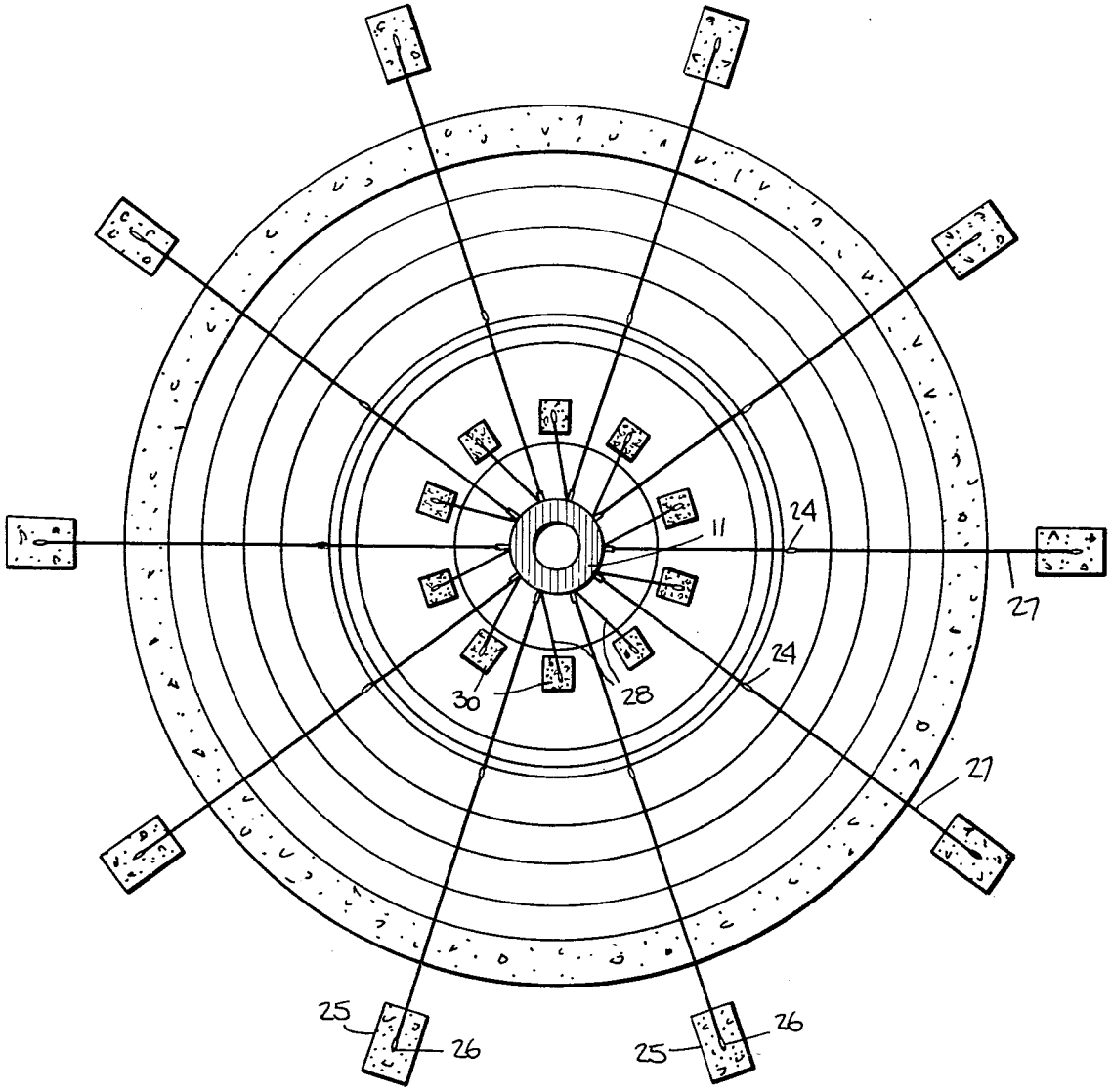
FIG. 2 is a top plan view of the structure of FIG. 1.

Referring now to the drawings in detail, and more specifically to FIGS. 1 and 2 thereof, I show a hyperbolic tower 10 constructed around a chimney 11 and supported on a base 12 which may be built as required to permit ambient air to enter and rise through the tower while fluid to be cooled descends into a pond 14.

Figures 4, 7, 8:
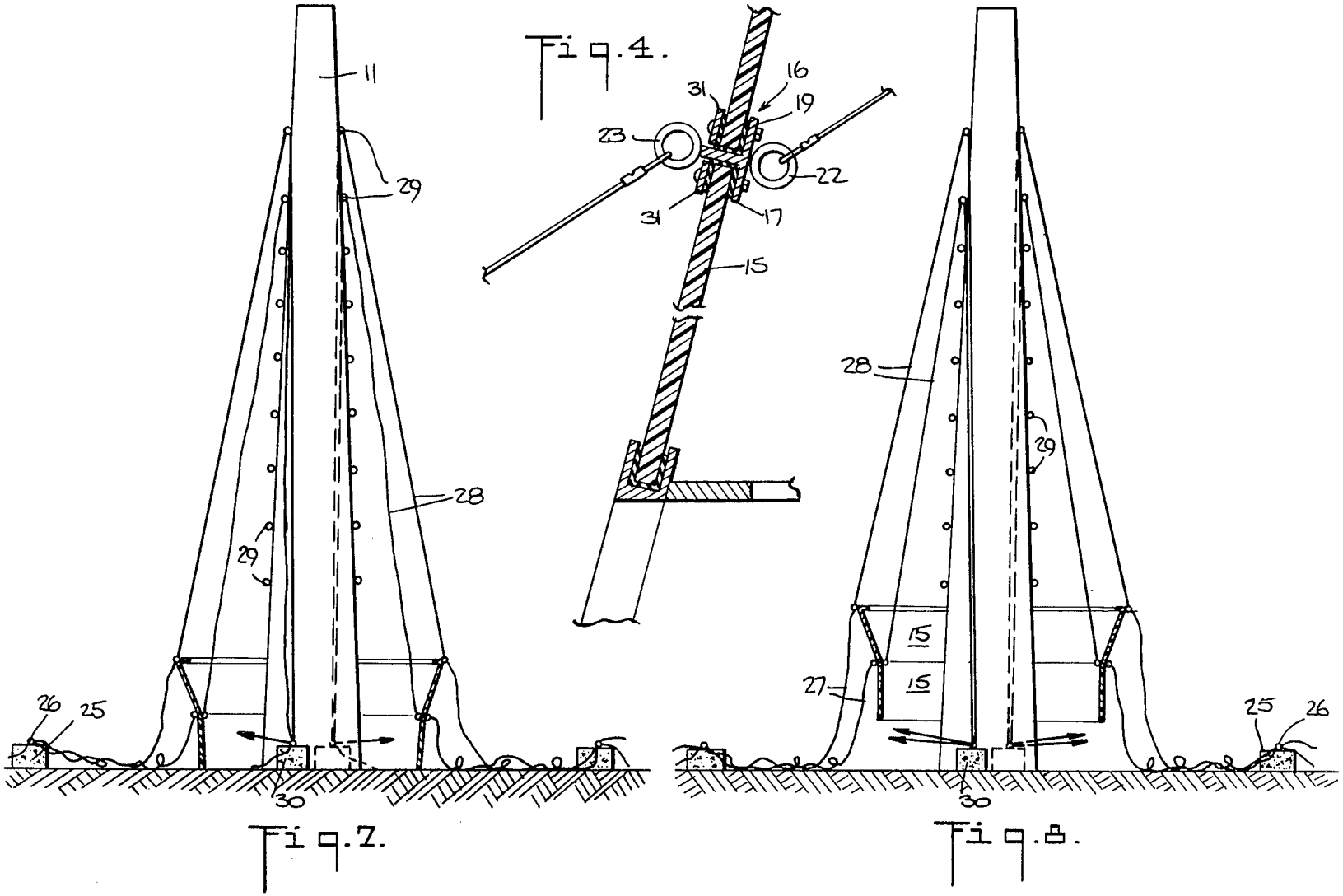
FIG. 4 is a detail view, partly in section, illustrating the lowermost and next upper plastic ring, the T-ring and sealing compound therebetween, all supported on a base with the above-mentioned cables in assembled position.

The tower 10 consists of a series of plastic rings 15 one atop the other in end to end relationship with sealing means 16 between adjacent rings 15. The plastic rings are formed of strong, inert plastic sheets, and the sealing means 16 may comprise annular metal T-rings disposed relatively to adjacent plastic rings so that the cross piece of the T overlaps interior marginal edges of the plastic rings and the central leg of the T extends therebetween. In FIG. 4, a suitable, weather resistant plastic or rubber sealing compound is shown sealing the several parts as at 19. As best shown in FIG. 3, the upper edge of the uppermost plastic ring 15 need not be fitted with a T-ring but may instead have a top ring 20 overlying same and secured thereto by a channel member 21 receiving the marginal edge of the plastic ring with sealing compound 19 therebetween and bolts fastening the parts together.

The inner and outer surfaces of the T-rings are equipped with pairs of rings 22 and 23, respectively, equidistantly spaced around the same, and the other surface of the top ring 20 has rings 24 fixed thereto at similarly spaced locations, as shown in FIGS. 1 to 4.

In final assembly, anchor means 25 are positioned equidistantly and radially outwardly of the tower. In FIG. 2, I illustrate these anchor means as concrete piles secured in the earth with loops 26 secured thereto and the anchor means shown as numbering the same as the pairs of rings 22, 23. In order to stabilize the tower, I employ a cable or guy 27 drawn taut between each ring 23 and its corresponding loop 26, and similar guys between the top loops 24 and the anchor means.

On the interior of the tower, a cable or guy 28 is connected to each ring 22 and extends inwardly and upwardly, around a sheave 29 carried by the chimney 11 as shown, or by a mast erected for the purpose where a chimney is not available, and downwardly to interior anchor means 30 which are structurally similar to anchor means 25. The location and number of anchor means 30 are sufficient to the purpose intended, but I prefer that they be substantially equidistantly spaced from one another and that there be the same number of anchor means 30 as there are anchor means 25 to assure the uniform stability of the tower.

As already stated, the top ring 20 has only a single set of rings 24 and these rings may each be used to secure a cable 27 as well as a cable 28 as shown in FIGS. 1 and 3.

If it is deemed necessary further to rigidify the structure, straps 31 may be positioned to encircle the exterior marginal edges of the plastic rings and these may be bolted to the interior cross pieces of the T-rings, as shown in FIG. 4, or they may simply be tightened down frictionally to engage the plastic rings with or without sealing compound between the two.

Figures 5, 6, 7:
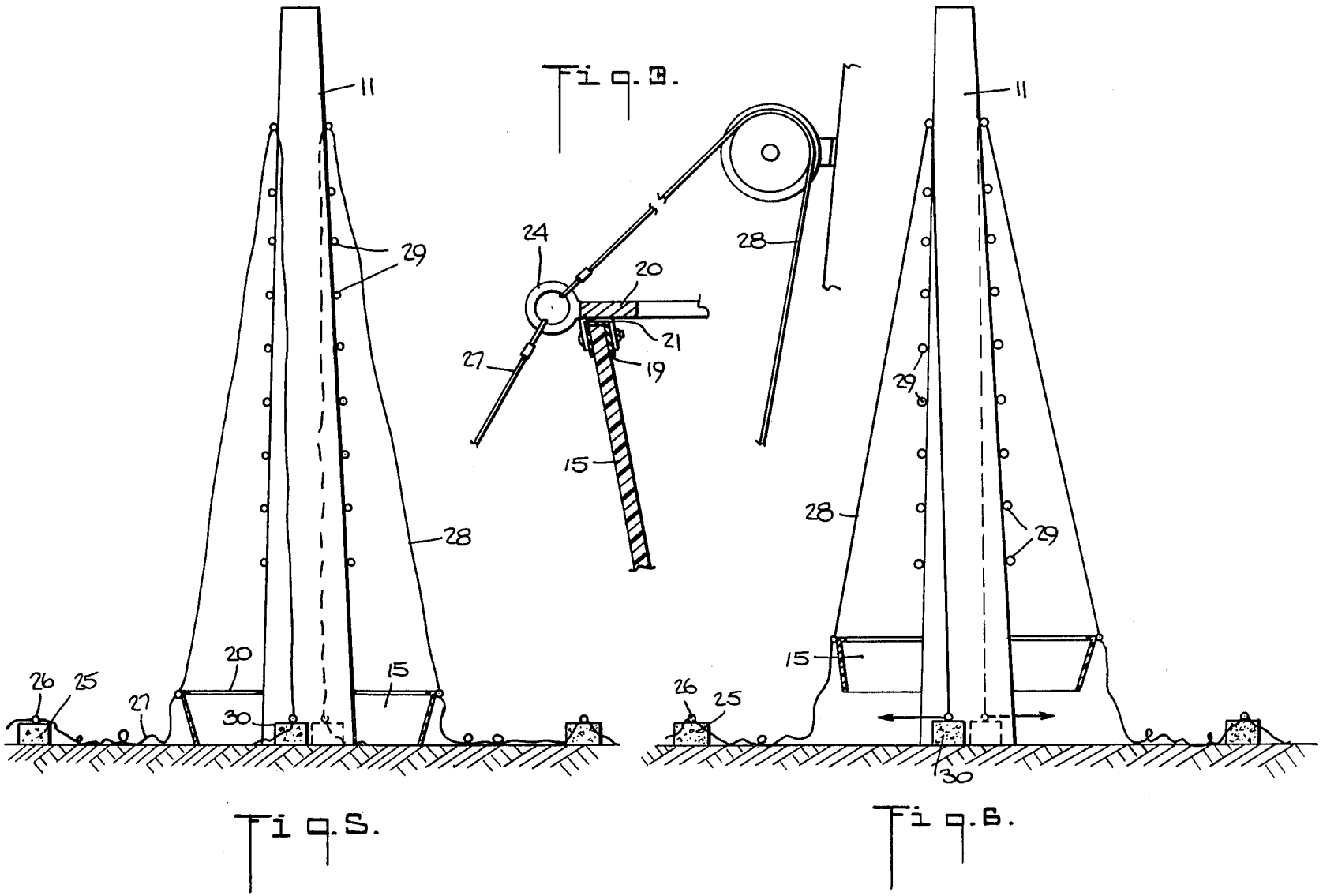
FIG. 5 is an elevational view illustrating the first ring prior to lifting and employing a chimney as a central mast.
FIG. 6 is similar to FIG. 5 but shows the first ring elevated to its first position.
FIGS. 7 and 8 are similar to FIGS. 5 and 6 but show successive steps in the erection of the tower.

To erect a tower of the type described around a chimney 11, for example, the chimney is equipped with sets of sheaves 29, each set being vertically spaced from the other and comprising a number of sheaves circumferentially spaced around the chimney as shown in FIGS. 5 to 8. A first plastic ring 15 is formed around the base of the chimney and the top ring 20 is applied, the anchor means 25 and 30 having first been located. Cables 27 are connected at one end to the rings 24 and are made ready for fastening to the loops 26 on corresponding anchor means 25. Cables 28 are secured at one end of rings 24, are reeved about the uppermost sheaves 29 are are made ready for fastening to anchor means 30. The first ring is then raised to a desired position above the ground, as shown in FIG. 6, by drawing on the free ends of cables 28.

A second ring 15 is formed below the first ring with the sealing means 16 properly assembled between the rings 15, all as shown in FIG. 7. Both rings 15 are then raised as shown in FIG. 8 and the process is repeated until the first or uppermost plastic ring 15 reaches the desired height. The cables 28 are then secured to their respective anchor means 30 and the cables 27 are drawn taut and secured to their respective anchor means.

From the foregoing description, it will be seen that I contribute a tower structure of the class described and a method of erecting same by which I am able materially to reduce the construction time, the necessary labor force and the overall cost relative to those of tower structures known to me. It will further be seen that, while I have chosen to describe a hyperbolic cooling tower and method of erecting same, my novel concept is readily applicable to other tower structures such as grain elevators, silos and the like.

I believe that the construction of my novel tower structure and its method of erection will now be understood, and that the advantages thereof will be fully appreciated by those persons skilled in the art.

I claim:

1. Method of erecting a structure comprising: positioning a series of sheave means at each of a plurality of levels on a vertical rigid member, positioning a first ring on the ground surrounding the base of said rigid member, raising said ring to a position above the ground by means of cable means reeved through one series of said sheave means, positioning a second ring below said first ring, inserting sealing means between adjacent circumferential ends of said rings to seal the same, raising said first and second rings by means of cables reeved through said one series of sheave means and a second lower series thereof, respectively, repeating said steps adding rings until said first ring reaches the desired height, and anchoring said cables.

2. Method according to claim 1, characterized by forming loops on said sealing means and connecting said cable means and said stabilizing means to said loops.

3. Method according to claim 1, characterized by first erecting said rigid member and sheave means at the desired site.

4. Method according to claim 1, characterized by positioning anchor means around the base of said structure and connecting stabilizing means to said anchor means and to said structure at various levels thereof.

* * * * *